US007183976B2

(12) United States Patent
Wu et al.

(10) Patent No.: US 7,183,976 B2
(45) Date of Patent: Feb. 27, 2007

(54) COMPACT INVERTED-F ANTENNA

(75) Inventors: Ke-Li Wu, Hong Kong (HK); Yong Huang, Shaanxi (CN); Wai-Cheung Tang, Mannheim (CA)

(73) Assignees: Mark IV Industries Corp., Mississauga (CA); Chinese University of Hong Kong, Hong Kong (HK)

( * ) Notice: Subject to any disclaimer, the term of this patent is extended or adjusted under 35 U.S.C. 154(b) by 0 days.

(21) Appl. No.: 10/895,783

(22) Filed: Jul. 21, 2004

(65) Prior Publication Data

US 2006/0017628 A1 Jan. 26, 2006

(51) Int. Cl.
*H01Q 1/38* (2006.01)

(52) U.S. Cl. ..... 343/700 MS; 343/702

(58) Field of Classification Search ..... 343/702, 343/700 MS, 895

See application file for complete search history.

(56) References Cited

U.S. PATENT DOCUMENTS

| | | | | |
|---|---|---|---|---|
| 6,222,496 | B1 | 4/2001 | Liu | 343/846 |
| 6,512,493 | B2 * | 1/2003 | Park et al. | 343/895 |
| 6,628,241 | B1 | 9/2003 | Fukushima et al. | 343/895 |
| 6,630,906 | B2 | 10/2003 | Tomomatsu et al. | 343/700 MS |
| 6,768,460 | B2 * | 7/2004 | Hoashi et al. | 343/700 MS |
| 6,781,553 | B2 * | 8/2004 | Iguchi et al. | 343/725 |
| 6,819,289 | B2 * | 11/2004 | Kim et al. | 343/700 MS |
| 6,856,285 | B2 * | 2/2005 | Bettin et al. | 343/700 MS |
| 7,034,750 | B2 * | 4/2006 | Asakura et al. | 343/700 MS |
| 2001/0043161 | A1 * | 11/2001 | Tseng et al. | 343/895 |
| 2003/0025637 | A1 | 2/2003 | Mendolia et al. | 343/702 |
| 2004/0056804 | A1 | 3/2004 | Kadambi et al. | 343/702 |
| 2004/0080458 | A1 * | 4/2004 | Sekine et al. | 343/702 |
| 2005/0110684 | A1 * | 5/2005 | Liu | 343/700 MS |
| 2005/0248489 | A1 * | 11/2005 | Kim et al. | 343/702 |
| 2005/0285797 | A1 * | 12/2005 | Kalliokoski et al. | 343/702 |

OTHER PUBLICATIONS

J. Howell, "Microstrip Antennas," IEEE Trans. on Antennas and Propagation, vol. 23, No. 1, pp. 90-93, Jan. 1975.

R.J.F. Guertler, "Isotropic transmission line antenna and its toroid pattern modification," IEEE Trans. on Antennas and Propagation, vol. 25, No. 3, pp. 386-392, May 1977.

J. Rashad and C.T. Tai, "A new class of resonant antennas," IEEE Antennas and Propagation, vol. 39, No. 9, pp. 1428-1430, Sep. 1991.

T. Hosoe and K. Ito, "Dual-band planar inverted F antenna for lptop computers," IEEE AP-S Digest, vol. 3, pp. 87-90, Jun. 22-27, 2003.

M. Ali and G.J. Hayes, "Analysis of integrated inverted-F antennas for Bluetooth applications," IEEE AP-S Digest, pp. 21-24, Nov. 6-8, 2000.

(Continued)

*Primary Examiner*—Hoanganh Le
*Assistant Examiner*—Tung Le
(74) *Attorney, Agent, or Firm*—Pyle & Piontek

(57) ABSTRACT

A compact inverted-F antenna having a radiator arm formed from portions disposed in two parallel spaced apart planes and connected together electrically to form a folded meander-line topology. The planes may be defined by the surfaces of a dielectric substrate and the radiator arm may be formed from upper and lower conductive traces printed on either side of the dielectric substrate and interconnected serially through filled via holes. The antenna includes a ground plane parallel to and spaced apart from the radiator arm. The ground plane may be a grid conductive wall formed from filled via holes through the dielectric substrate.

21 Claims, 5 Drawing Sheets

OTHER PUBLICATIONS

C. Soras, et al., "Analysis and design of an inverted-F antenna of an inverted-F antenna printed on . . . " IEEE Antennas and Propagation Mag. vol. 44, No. 1, pp. 37-43, Feb. 2002.

R. Wansch, H. Humpfer, J. Hupp, "A integrated F-antenna for diversity reception in a DECT data transmission," IEEE AP-S Digest, vol. 1, pp. 278-281, Jul. 16-21, 2000.

M. Ali, R.A. Sadler, G.J. Hayes, "A uniquely packaged internal inverted-F antenna for Bluetooth or wireless LAN application," IEEE Antennas . . . , vol. 1, No. 1, pp. 5-7, 2002.

Z.N. Chen, K. Hirasawa, K.W. Leung, K.M. Luk, "A new inverted F-antenna with a ring dieletric resonator" IEEE Trans. on Vehicular . . . , vol. 48, No. 4, pp. 1029-1032, Jul. 1999.

Y.L. Kuo and K.L. Wong, Coplanar waveguide-fed folded inverted-F antenna for UMTS application, "IEEE Microwave and Optical . . . " vol. 32, No. 5, pp. 364-366, Mar. 5, 2002.

T.J. Warnagiris and T.J. Minardo, "Performance of a meandered line as an electrically small . . . ", IEEE Trans. on . . . , vol. 46, No. 12, pp. 1797-1801, Dec. 1998.

S.M. Moon and J.Y. Woo, "Folded meander line and multilayerred dielectric chip antenna for surface mount," 2001 Asia-Pacific Microwave . . . , vol. 2, pp. 472-475, Dec. 3-6, 2001.

* cited by examiner

COMPACT INVERTED-F ANTENNA

FIELD OF THE INVENTION

The present invention relates to radio frequency antennas and, in particular, to compact inverted-F radio frequency antennas.

BACKGROUND OF THE INVENTION

Radio frequency (RF) antennas are used in a variety of devices to transmit and receive communications. Many applications have strict space and volume restrictions and require antennas that function efficiently, but that are relatively small. This is especially the case with mobile devices, such as cellular phones, radio frequency identification (RFID) tags, and mobile handheld devices.

To maintain a low profile some devices employ an inverted-F antenna. This antenna has a low profile because the radiator arm is parallel to the ground plane, rather than perpendicular, as is the case with most antennas. U.S. Pat. No. 6,222,496 issued to Liu teaches an example of an inverted-F antenna.

Another option for reducing the size of antennas is to employ a meander-line antenna. The meander-line antenna is a conventional antenna that features a winding back-and-forth topology, as shown in FIG. 4 herein. Constructing the antenna such that it winds back and forth in a switchback fashion helps to conserve space and retains a relatively high radiation resistance as compared to other winding configurations, such as a helix antenna. An even more compact meander-line antenna is described in U.S. Pat. No. 6,630,906 issued to Tomomatsu et al., which teaches forming a dielectric block around part of a meander-line antenna and then folding the exposed portion of the meander-line antenna around the dielectric block.

SUMMARY OF THE INVENTION

The present invention provides a compact inverted-F antenna. The antenna according to the present invention includes an inverted-F antenna having radiator arm having portions disposed in two parallel spaced apart planes and connected together electrically. The radiator arm forms a folded meander-line topology.

In one aspect, the present invention provides an inverted-F antenna that includes a radiator arm having a first portion and a second portion, the first portion being disposed in a first plane, the second portion being disposed in a second plane, the first plane being spaced apart from and substantially parallel to the second plane, the first portion and the second portion being electrically connected and the radiator arm being disposed along a radiator arm axis and having an open end and a shorted end. The antenna further includes a ground plane spaced apart from and substantially parallel to the radiator arm axis, a shorting strip connected to the ground plane and to the shorted end of the radiator arm, and a feed line connected to the radiator arm between the shorted end and the open end. The radiator arm forms a folded meander-line topology.

In another aspect, the present invention provides a compact inverted-F antenna. The antenna includes a dielectric block having an upper surface and a lower surface, the upper surface being spaced apart and substantially parallel to the lower surface. It also includes a radiator arm including an upper trace and a lower trace, the upper trace being printed upon the upper surface, the lower trace being printed upon the lower surface, the radiator arm having an open end and a shorted end, and the radiator arm including filled via holes electrically connecting the upper trace and the lower trace. The antenna further includes a ground plane printed on the dielectric block, and spaced apart from and substantially parallel to the radiator arm, a shorting strip connected to the ground plane and to the shorted end of the radiator arm, and a feed line connected to the radiator arm between the shorted end and the open end. The radiator arm forms a three-dimensional meander-line antenna topology, wherein the upper trace includes a switchback section in the three-dimensional meander-line antenna topology.

In another aspect, the present invention provides an inverted-F antenna having a folded meander-line radiator arm topology, which results in a compact antenna. Configuring the antenna in an inverted-F format, with the compact antenna spaced apart from and parallel to the ground plane, provides a low profile and improved utilization of space.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

Figure 1:
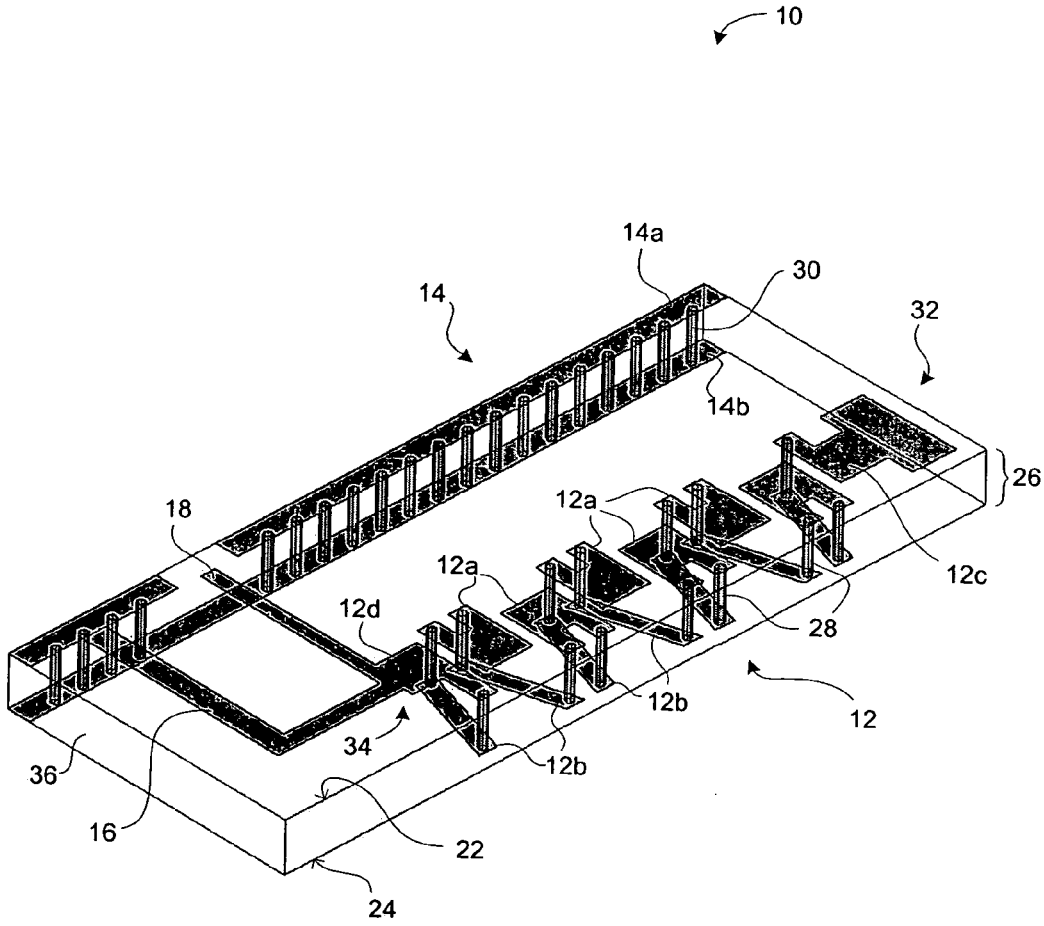
FIG. 1 shows a perspective view of an embodiment of an antenna in accordance with the present invention.
Figure 2:
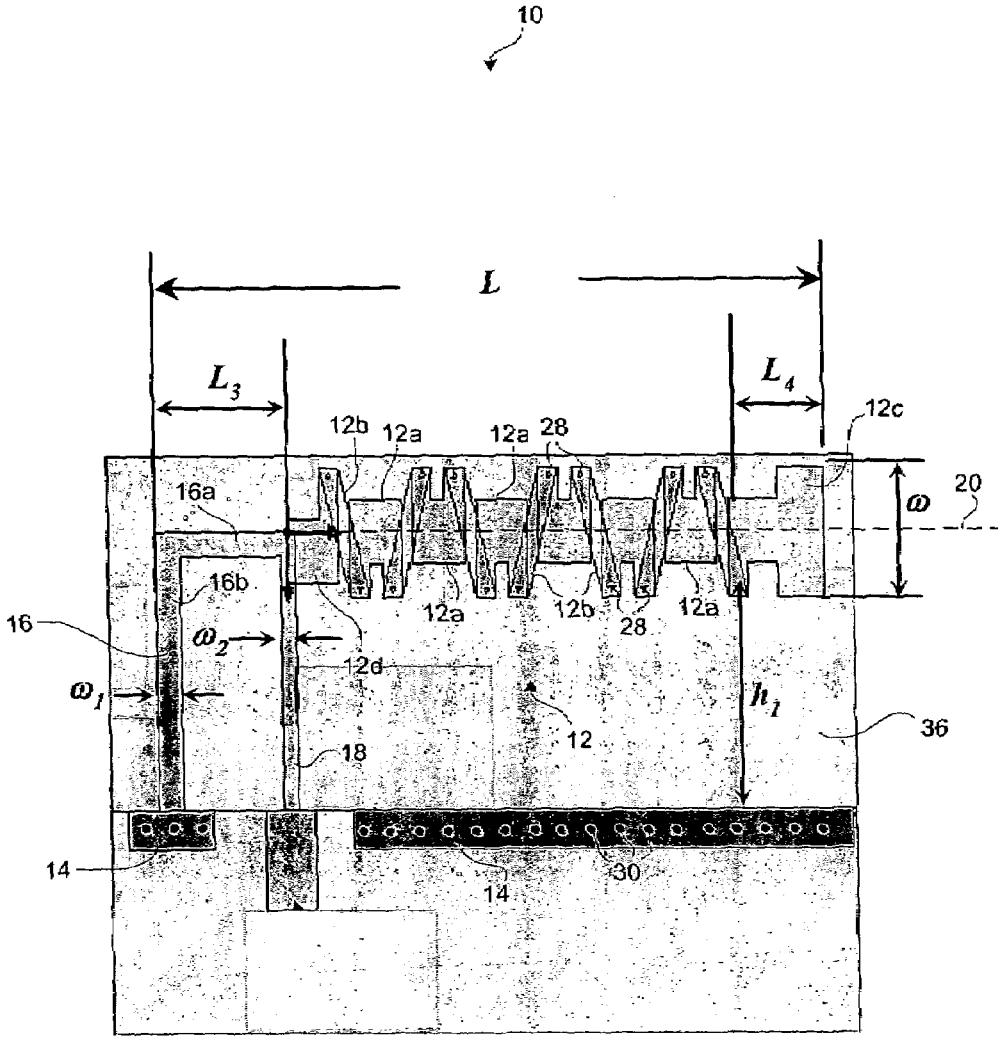
FIG. 2 shows a top view of the embodiment of the antenna shown in FIG. 1.

Reference is first made to FIG. 1, which shows a perspective view of an embodiment of an antenna 10 in accordance with the present invention. FIG. 2 shows a top view of the embodiment of the antenna 10 shown in FIG. 1.

The antenna 10 includes a radiator arm 12, a ground plane 14, a shorting strip 16, and a feed line 18. The antenna 10 is configured as an inverted-F antenna, with the radiator arm 12 having a free end 32 and a shorted end 34. The shorted end 34 is connected to the ground plane 14 by the shorting strip 16. The feed line 18 is connected to the radiator arm 12 at a point between the shorted end 34 and the free end 32. In one embodiment, the radiator arm 12 includes a shorted end mounting pad 12*d* to which both the shorting strip 16 and the feed line 18 are connected.

The radiator arm 12 of the antenna 10 includes upper portions 12*a* and lower portions 12*b*. The upper portions 12*a* of the radiator arm 12 are disposed in an upper plane 22. The lower portions 12*b* of the radiator arm 12 are disposed in a lower plane 24. The upper plane 22 and the lower plane 24 are substantially parallel to one another and are spaced apart by a distance 26. The upper portions 12*a* and lower portions 12*b* of the radiator arm 12 may be printed upon a substrate 36, which has a thickness that provides the distance 26. The free end 32 of the radiator arm 12 may terminate in a t-shaped open end conductor pad 12*c*.

The upper portions 12*a* and the lower portions 12*b* of the radiator arm 12 are electrically connected to one another by connecting elements 28. In one embodiment, the connecting elements 28 comprise filled via holes formed within the substrate 36 to connect the upper portions 12*a* to the lower portions 12*b*.

The upper portions 12*a* and lower portions 12*b* are configured to provide the radiator arm 12 with a folded meander-line topology. The radiator arm 12 is disposed along a radiator arm axis 20. The radiator arm axis 20 is substantially parallel to and spaced apart from the ground plane 14.

In one embodiment, the radiator arm 12 comprises alternating and overlapping upper portions 12*a* and lower portions 12*b* disposed along the radiator arm axis 20. Beginning at the shorted end 34 of the radiator arm 12, the shorted end mounting pad 12*d* is connected to an end of one of the lower portions 12*b* via one of the connecting elements 28. The other end of the lower portion 12*b* is connected to one of the upper portions 12*a* via another of the connecting elements 28. Along the radiator arm axis 20, each upper portion 12*a* is connected to two adjacent lower portions 12*b* via connecting elements 28 so as to bridge or connect the adjacent ends of the two adjacent lower portions 12*b*. Similarly, each lower portion 12*b* is connected to two adjacent upper portions 12*a* (except for the outer most lower portions 12*b* which are connected to one upper portion 12*b* and either the shorted end mounting pad 12*d* or the open end conductor pad 12*c*) via connecting elements 28.

The lower portions 12*b* extend transverse to the radiator arm axis 20 and each of the two ends of the lower portions 12*b* is connected to a connecting element 28. Accordingly, each lower portion 12*b* is connected to a connecting element 28 on either side of the radiator arm axis 20.

Each upper portion 12*a* extends transverse to the radiator arm axis 20 and is connected to two connecting elements 28 on the same side of the radiator arm axis 20. An upper portion 12*a* is connected to connecting elements 28 on an opposite side of the radiator arm axis 20 from the connecting elements 28 attached to an adjacent upper portion 12*a*. In one embodiment, the upper portions 12*a* comprise u-shaped or v-shaped conductive traces. A connecting element 28 is connected to each of the two spaced apart upper ends of the u-shaped or v-shaped conductive traces.

In one embodiment, as shown in FIGS. 1 and 2, the shorting strip 16 comprises an L-shaped conductive trace connected between the shorted end mounting pad 12*d* and the ground plane 14. The shorting strip 16 includes a longitudinal portion 16*a* extending parallel to the radiator arm axis 20 and a transverse portion 16*b* extending substantially perpendicular to the radiator arm axis 20. It will be appreciated that the shorting strip 16 may have other configurations or dimensions, not limited to an L-shape. Adjustments to the shape or dimensions of the shorting strip 16 will alter the impedance matching.

Figure 3:
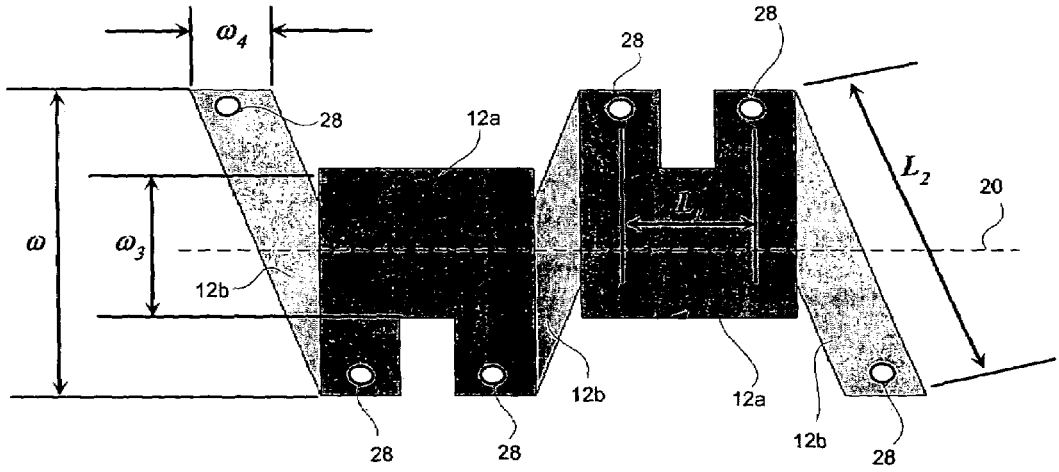
FIG. 3 shows a part of the radiator arm shown in FIG. 2.

FIG. 3 shows a part of the radiator arm 12 shown in FIG. 2. Referring now to FIGS. 2 and 3, in one embodiment, the geometry of the antenna 10 results in an occupied volume of $(w+h_1)LT$, where w is the span of the radiator arm 12 from the point closest the ground plane 14 to the point furthest from the ground plane 14, $h_1$ is the distance between the radiator arm 12 and the ground plane 14, L is the length of the radiator arm 12 including the shorting strip 16, and T is the thickness of between the upper and lower planes 32, 34. The distance between the radiator arm 12 and the ground plane 14 is one of the factors that may be altered to provide for a different resonant frequency.

In one embodiment, the upper portions 12*a* comprise u-shaped elements having a main body portion and two spaced apart connector portions extending outwards from the same side of the main body portion. Each connector portion is connected to a filled via hole. The main body portion has a length $L_1$ from via hole to via hole and a width of $w_3$.

The lower portions 12*b* comprise trapezoidal elements having a length $L_2$ and a width $w_4$. The lower portions 12*b* are connected to a filled via hole at either end.

With the geometry described above, the overall length $L_{Total}$ of the antenna 10 may determined from the formula:

$$L_{Total}=(n+1)\cdot L_2+2(n+1)\cdot T+h_1+n\cdot L_1+L_4+L_3 \quad (1)$$

In one embodiment, the total electric length $L_{Total}$ of the antenna 10 is approximately one-quarter wavelength of the operating frequency.

Those of ordinary skill in the art will appreciated that the meander-line topology of the radiator arm 12 may be obtained using upper and lower portions 12*a*, 12*b* having a different shape from the one depicted in the Figures. Altering the shape of the upper and lower portions 12*a*, 12*b* will alter the tuning of the antenna.

Referring again to FIGS. 1 and 2, the ground plane 14 is substantially parallel to and spaced apart from the radiator arm 12. The ground plane 14 comprises an upper ground portion 14*a* disposed in the upper plane 22 and a lower ground portion 14*b* disposed in the lower plane 24. The upper ground portion 14*a* and the lower ground portion 14*b* are electrically connected to provide a common ground. In one embodiment, the upper and lower ground portions 14*a*, 14*b* are connected by an array of connecting elements 30, such as filled via holes. In this embodiment, the ground plane 14 comprises a grounded grid wall substantially parallel to the radiator arm axis 20 and substantially perpendicular to the upper and lower planes 22, 24. The grounded grid wall provides shielding protection to other circuit components from the radiated energy of the antenna 10 radiator arm 12. It also increases the effective ground of the antenna 10, thereby increasing the antenna gain and working frequency bandwidth.

Those of ordinary skill in the art will understand that in other embodiments, the ground plane may comprise a ground trace on the lower plane 24 connected to the shorting strip 16 by a via hole or other connecting element. In other embodiments, the ground plane may comprise a ground trace on the upper plane 22. In yet other embodiments, the ground plane comprises a ground trace on a surface or plane between the upper plane 22 or the lower plane 24. In such embodiments, the ground plane may or may not include a grid of filled via holes. It will be appreciated that the ground plane, in any of these forms, is intended to be connected to the system ground in the context of a particular application.

Providing for a folded meander-line antenna topology results in a compact antenna. Configuring the antenna 10 in an inverted-F format, with the compact antenna spaced apart from and parallel to the ground plane, results in a low profile and improved utilization of three-dimensional space.

The substrate 36 comprises a dielectric material. The substrate 36 may be ceramic based, organic based, or based upon any other substance that provides a stable dielectric constant and low loss. The connecting elements 28, 30 may, in one embodiment, comprise filled via holes connecting overlapping circuit traces on different layers of the substrate 36. In another embodiment, one or more of the connecting elements 28, 30 comprise printed traces on an exterior surface of the substrate 36. It will be appreciated that any other method or mechanism for connecting circuit traces on different layers/planes of the substrate 36 may be employed to provide for the connecting elements 28, 30.

Referring again to FIGS. 1 and 2, the open end conductor pad 12*c* is shown on the upper plane 22. In another embodiment, the open end conductor pad 12*c* is disposed on the lower plane 24. The antenna 10 may be mounted to a printed circuit board (PCB). With the open end conductor pad 12*c* disposed upon a surface in contact with the PCB, it may be soldered to a corresponding conductor pad disposed on the PCB surface. In such an embodiment, the soldering of the open end conductor pad 12*c* to another conductor pad alters the geometric size of the open end 32 of the radiator arm 12 and, accordingly, the resonant frequency of the antenna 10. This allows users of the antenna 10 to adjust the resonant frequency of the antenna 10 for particular applications by customizing the size of the conductor to which the open end conductor pad 12*c* is soldered.

The soldering of the open end conductor pad 12*c* to a corresponding conductor pad on the PCB also provides for mechanical stability during a reflow soldering process, which is a mounting process that may be used to produce products incorporating the antenna 10. It will be noted that the feed line 18 and the ground plane 14 are both located along a common edge of the substrate 36 and may be soldered to the PCB. The open end conductor pad 12*c* is proximate an opposite side of the substrate 36. Accordingly, during the reflow process having solder points on both sides of the substrate 36 will tend to provide mechanical stability to the substrate 36, whereas if solder points are located only on one side of the substrate 36 the substrate 36 may tilt or slide during reflow.

Those of ordinary skill in the art will appreciate the circuit traces described in the foregoing embodiments as being disposed in the upper plane may alternatively be disposed in the lower plane. Similarly, those elements described as being disposed in the lower plane may, in other embodiments, be located in the upper plane.

From the foregoing description, those of ordinary skill in the art will appreciate that the radiator arm 12 of the antenna 10 is formed in a folded meander-line topology having portions disposed in two parallel spaced-apart planes and connected together electrically. It will also be understood that an antenna according to the present invention may utilize a different configuration of traces in the upper plane 22 and the lower plane 24 in order to form a folded meander-line topology.

Figure 4:
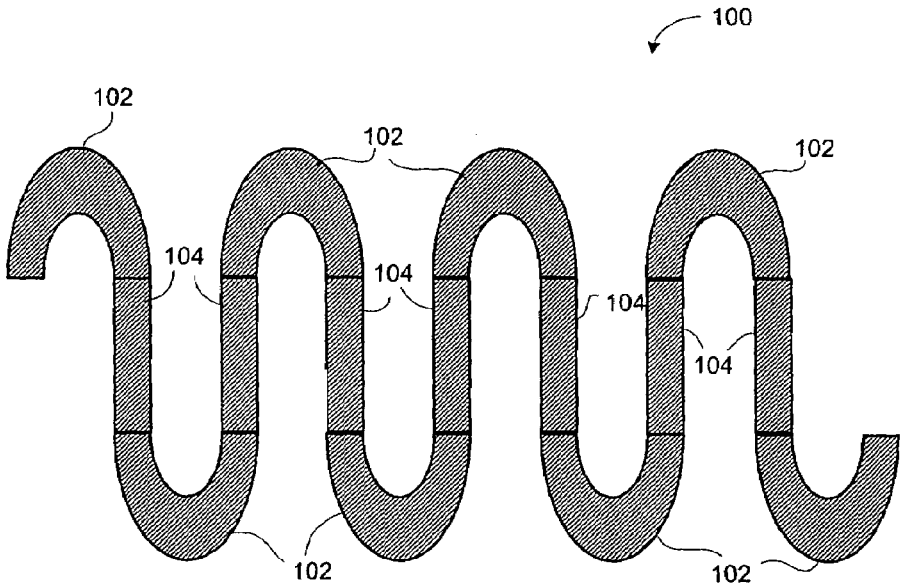
(PRIOR ART) Figure 4
FIG. 4 diagrammatically shows a planar meander-line topology.

Reference is now made to FIG. 4, which diagrammatically shows an example of conventional planar meander-line topology 100. The planar meander-line topology 100 includes a plurality of switchback sections, which in this example comprise arcuate sections 102, and a plurality of connecting sections 104. The arcuate sections 102 and the connecting sections 104 are arranged, alternating, so as to form a winding switchback path.

Figure 5:
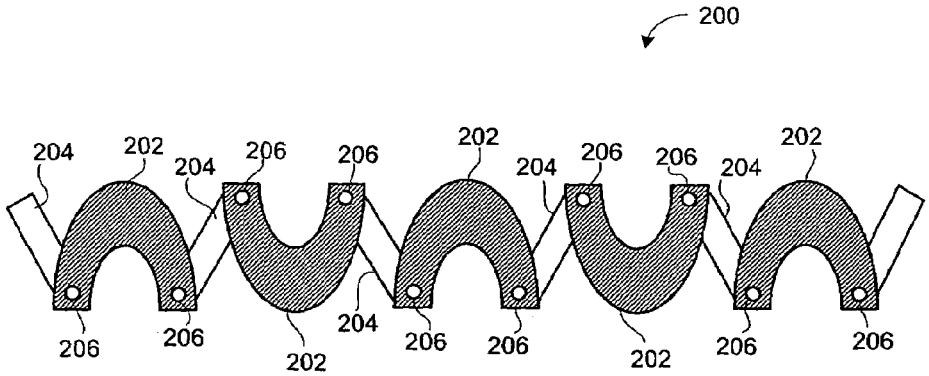
FIG. 5 diagrammatically shows a first embodiment of a folded meander-line topology.

Referring now to FIG. 5, there is shown a diagram of a first embodiment of a folded meander-line topology 200 according to the present invention. The folded meander-line topology 200 includes arcuate sections 202 and connecting sections 204. The arcuate sections 204 are located on an upper plane and the connecting sections 204 are located on a lower plane. The arcuate sections 204 are connected to the connecting sections 204 by way of via holes 206 extending between the upper and lower planes.

Those of ordinary skill in the art will recognize that the connecting sections 104 (FIG. 5) of the conventional planar meander-line topology 100 correspond to the connecting sections 204 and via holes 206 of the first embodiment folded meander-line topology 200. It will also be understood that the conventional arcuate sections 102 (FIG. 5) are folded inwards to form the arcuate sections 202 shown in FIG. 5. It will be appreciated that this first embodiment folded meander-line topology 200 corresponds to the topology formed by the radiator arm 12 (FIG. 1) shown in FIGS. 1 and 2.

Figure 6:
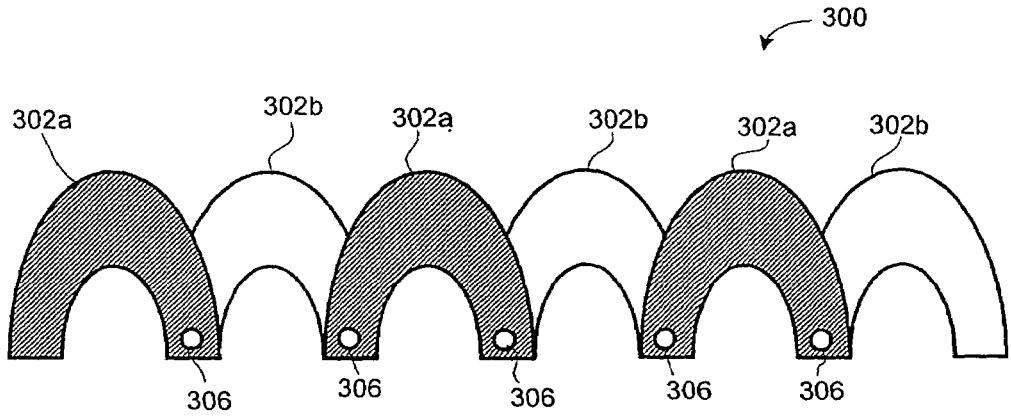
FIG. 6 diagrammatically shows a second embodiment of a folded meander-line topology.

FIG. 6 diagrammatically shows a second embodiment of a folded meander-line topology 300 according to the present invention. The folded meander-line topology 300 includes arcuate sections 302. In particular, it includes upper arcuate sections 302*a* disposed in an upper plane and lower arcuate sections 302*b* disposed in a lower plane. The ends of the upper arcuate sections 302*a* overlap the ends of the lower arcuate sections 302*b*. The ends of the upper arcuate sections 302*a* and the ends of the lower arcuate sections 302*b* are electrically connected through via holes 306 extending between the upper and lower planes.

Those skilled in the art will recognize that the connecting sections 104 (FIG. 5) of the conventional planar meander-line topology 100 correspond to via holes 306 of the second embodiment folded meander-line topology 300. It will also be understood that approximately every second conventional arcuate section 102 is folded or flipped so as to produce the arcuate sections 302*a* and 302*b*. It will be appreciated that, in some embodiments, via holes 306 may be printed circuit traces on the side of a dielectric block.

Figure 7:
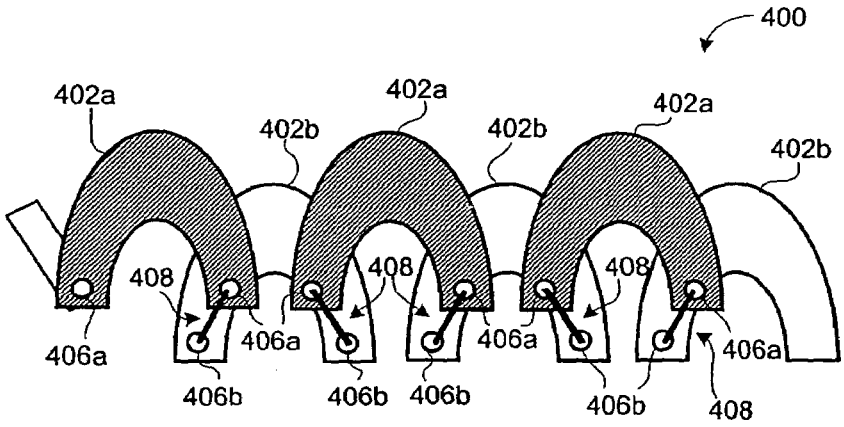
FIG. 7 diagrammatically shows a third embodiment of a folded meander-line topology.

FIG. 7 diagrammatically shows a third embodiment of a folded meander-line topology 400 according to the present invention. The folded meander-line topology 400 includes arcuate sections 402. In particular, it includes upper arcuate sections 402*a* disposed in an upper plane and lower arcuate sections 402*b* disposed in a lower plane. The upper arcuate sections 402*a* overlap the lower arcuate sections 402*b* to a greater degree than was shown in FIG. 6, i.e. in each plane the arcuate sections 402*a* or 406*b* are arranged closer together than in the second embodiment folded meander-line topology 300 (FIG. 7). Accordingly, the ends of the upper arcuate sections 402*a* are not disposed directly above the ends of the lower arcuate sections 402*b*. Nevertheless, the ends of the upper arcuate sections 402*a* and the ends of the lower arcuate sections 402*b* are electrically connected through connecting elements 408 extending between the upper and lower planes.

The connecting elements 408 may be implemented in variety of ways. In one embodiment, the connecting elements 408 may comprise an upper via hole 406*a* between the upper plane and an intermediate plane, a lower via hold 406*b* between the lower plane and the intermediate plane, and a circuit trace at the intermediate plane connecting the upper via hole 406*a* to the lower via hole 406*b*. In some embodiments, the connecting elements 408 may also comprise printed circuit traces on the side walls of the dielectric block.

Those skilled in the art will recognize that the connecting sections 104 (FIG. 5) of the conventional planar meander-line topology 100 correspond to the connecting elements 408 of the third embodiment folded meander-line topology 400. It will also be understood that about every second conventional arcuate section 102 is folded or flipped so as to arrive at the arcuate sections 402*a* and 402*b* shown in FIG. 7.

Those of ordinary skill in the art will appreciate that, although the foregoing description of folded meander-line topologies employ arcuate switchback sections, the switchback sections need not be arcuate. They may take other shapes or forms, such as, for example, the square form shown in FIGS. 1 and 2.

The antenna 10 may be manufactured using low temperature co-fired ceramic (LTCC) technology, conventional PCB manufacturing technology, or by any other manufacturing technology that provides for connecting via holes or circuit traces on a multiple layered substrate.

It will be appreciated that the antenna 10 may be built as an integrated part of a module or as stand-alone parts.

Implementations of the present invention may find application in a variety of technologies, including RFID tags, miniature short-range radio modules, mobile telephony, and others.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An inverted-F antenna, comprising:

a radiator arm having a first portion and a second portion, said first portion being disposed in a first plane, said second portion being disposed in a second plane, said first plane being spaced apart from and substantially parallel to said second plane, said first portion and said second portion being electrically connected, and said radiator arm being disposed along a radiator arm axis and having an open end and a shorted end;

a ground plane spaced apart from and substantially parallel to said radiator arm axis;

a shorting strip connected to said ground plane and to said shorted end of said radiator arm; and a feed line connected to said radiator arm between said shorted end and said open end;

wherein said radiator arm forms a folded meander-line topology, and wherein said first portion comprises at least one switchback section in said folded meander-line topology.

2. The antenna claimed in claim 1, wherein said first portion partly overlaps said second portion.

3. The antenna claimed in claim 1, wherein said first portion includes a plurality of first conductive traces and wherein said second portion includes a plurality of second conductive traces.

4. The antenna claimed in claim 3, wherein at least one of said first conductive traces partly overlaps at least one of said second conductive traces.

5. The antenna claimed in claim 3, wherein said first conductive traces and said second conductive traces are serially connected, each of said plurality of second conductive traces being electrically connected to at least one adjacent pair of said first conductive traces.

6. The antenna claimed in claim 3, further including filled via holes connecting said first conductive traces to said second conductive traces.

7. The antenna claimed in claim 6, wherein at least one of said second conductive traces is connected to two of said filled via holes.

8. The antenna claimed in claim 7, wherein at least one of said first conductive traces is connected to two of said filled via holes.

9. The antenna claimed in claim 3, wherein said first conductive traces and said second conductive traces are alternately disposed along said radiator arm axis such that each first conductive trace overlaps at least one second conductive trace, and wherein said first and second conductive traces are serially connected through filled via holes connecting overlapping conductive traces.

10. The antenna claimed in claim 3, wherein said first conductive traces comprise u-shaped conductive traces, wherein said first conductive traces extend transverse to said radiator arm axis, and wherein said first conductive traces are connected to two filled via holes on one side of said radiator arm axis.

11. The antenna claimed in claim 3, wherein said second conductive traces extend transverse to said radiator arm axis and wherein said second conductive traces are connected to a filled via hole on either side of said radiator arm axis.

12. The antenna claimed in claim 1, further comprising a dielectric block defining said first plane and said second plane.

13. The antenna claimed in claim 12, wherein said upper portions and said lower portions are electrically connected through filled via holes.

14. The antenna claimed in claim 1, wherein said ground plane includes a first ground plane disposed in said first plane and a second ground plane disposed in said second plane, and wherein said first and second ground planes are electrically connected.

15. The antenna claimed in claim 1, wherein said ground plane comprises a grid conductive wall extending between said first plane and said second plane.

16. The antenna claimed in claim 1, wherein said shorting strip comprises an L-shaped conductive trace.

17. The antenna claimed in claim 1, wherein said feed line is connected to said shorted end of said radiator arm.

18. A compact inverted-F antenna, comprising:

a dielectric block having an upper surface and a lower surface, said upper surface being spaced apart and substantially parallel to said lower surface;

a radiator arm including an upper trace and a lower trace, said upper trace being printed upon said upper surface, said lower trace being printed upon said lower surface, said radiator arm having an open end and a shorted end, and said radiator arm including filled via holes electrically connecting said upper trace and said lower trace;

a ground plane printed on said dielectric block, and spaced apart from and substantially parallel to said radiator arm;

a shorting strip connected to said ground plane and to said shorted end of said radiator arm; and a feed line connected to said radiator arm between said shorted end and said open end, wherein said radiator arm forms a three-dimensional meander-line antenna topology and wherein said upper trace comprises a switchback section in said three-dimensional meander-line antenna topology.

19. The antenna claimed in claim 18, wherein said upper trace at least partially overlaps said lower trace.

20. The antenna claimed in claim 18, wherein said upper trace comprises a plurality of switchback sections and wherein said lower trace comprises a plurality of connecting sections, and wherein said switchback sections and said connecting sections are serially connected, each of said plurality of connecting sections being electrically connected to at least one adjacent pair of switchback sections.

21. The antenna claimed in claim 18, wherein said feed line is connected to said shorted end of said radiator arm.

* * * * *